United States Patent [19]

Schell

[11] Patent Number: 4,687,241

[45] Date of Patent: Aug. 18, 1987

[54] GRIPPER HEAD

[75] Inventor: Ferenc Schell, Niedergosgen, Switzerland

[73] Assignee: Polytex AG, Glattbrugg, Switzerland

[21] Appl. No.: 811,287

[22] Filed: Dec. 20, 1985

[30] Foreign Application Priority Data

Dec. 21, 1984 [CH] Switzerland ..... 6118/84

[51] Int. Cl.[4] ..... B65H 3/22; B65H 3/48

[52] U.S. Cl. ..... 294/61; 271/18.3

[58] Field of Search ..... 294/61, 100, 94, 110.1; 271/18.3, 19, 10, 141, 168, 119, 252, 267, 268; 221/213, 210, 215; 901/35; 414/730

[56] References Cited

U.S. PATENT DOCUMENTS

| | | | |
|---|---|---|---|
| 4,009,786 | 3/1977 | Littlewood | 294/61 |
| 4,386,770 | 6/1983 | Hellin | 294/61 |
| 4,579,331 | 4/1986 | Nestler et al. | 294/61 |

FOREIGN PATENT DOCUMENTS 238640 2/1965 Austria .

*Primary Examiner*—James B. Marbert

*Attorney, Agent, or Firm*—Willian Brinks Olds

[57] ABSTRACT

A gripper head for the pick-up of a single piece of material from a stack of such pieces. The gripper head is provided with curved needles mounted on the ends of two concentric hollow cylinders. Each hollow cylinder comprises a spiral guide slit. The pitch direction of the guide slit of one cylinder is opposite the pitch direction of the guide slit of the other cylinder. The guide slits cooperate with the gripper head casing to produce rotation of the cylinders in directions opposite to one another during axial advancement of the cylinders within the casing. The cylinders are advanced within the casing by means of a pressure bolt connected to the cylinders. The magnitude of the advancement is determined by the position of an adjustable stop ring located within the casing. In operation, the two sets of curved needles extend from the casing edge and simultaneously rotate in opposite directions in an adjustable and retractable fashion.

13 Claims; 7 Drawing Figures

GRIPPER HEAD

BACKGROUND OF THE INVENTION

The present invention relates to an apparatus known as a gripper head for singly picking-up, with the aid of curved needles, the uppermost lying piece of fabric or similar stickable material from a stack of such material pieces, wherein the curved needles are mounted on the ends of hollow cylinders which are arranged concentrically and are rotatable in opposite directions so that the needles contact, penetrate and releasably hold the piece of material.

In the following discussion, for purposes of simplicity and clarity, the present invention will be described with reference to the singling of cloth or fabric pieces. However, it should be understood that the present invention can be used for the singling of other material pieces such as pieces of felt, carpet sections with rough surfaces, knitted pieces, leather pieces, foamed synthetic material pieces and other stacked stickable pieces of material.

Gripper heads have become known from the Austrian Pat. No. 238640. In this device, the surfaces of the cylinders, upon which the needles are mounted, protrude from the casing within which the cylinders are guided. This has the disadvantage that the device is useable only for a single thickness of material that corresponds to the penetration depth of the needles. If thicker or thinner substances are to be taken up singly, a device with longer or shorter needles must be used. A further disadvantage of this device is that the releasing of a piece of material that has been picked-up is relatively complicated. To release the material, the device uses a plurality of compressed air blow-out openings located in the hollow cylinders.

It is an object of the present invention to provide a gripper head of this type that can be used to singly pick-up substances of differing thicknesses and then without the aid of an external energy source, such as compressed air, release them.

SUMMARY OF THE INVENTION

This invention is directed to a gripper head for singly picking-up a piece of material from a stack by the use of needles to engage the material, wherein the needles are arranged on the ends of two concentric hollow cylinders and the cylinders are operable to advance towards the material and rotate in opposite directions with respect to one another.

According to this invention, at least two hollow cylinders are arranged concentrically and are rotatable with respect to one another. Each cylinder comprises a guide slit and an end which faces the material pieces. The guide slits are oriented with respect to the longitudinal axis of each cylinder such that in at least one of the cylinders the pitch direction of the guide slit is opposite to the pitch direction of at least one other cylinder. The cylinders are mounted in the casing such that through cooperation of the casing and the guide slits the cylinders rotate as they are axially translated within the casing. Due to the pitch direction of the guide slits, at least one of the cylinders rotates in one direction and at least one other cylinder rotates in the opposite direction during the axial advancement. A return spring is used to bias the axial translation of the cylinders. A plurality of needles are arranged so as to protrude from the face ends of the concentric cylinders. The needles, cylinders and casings cooperate such that in one axially translated position the needles extend beyond the edge of the casing and in another axially translated position the needles do not extend beyond the edge of the casing.

One advantage of the present invention is that the gripper head can release a piece of material that has been picked-up without the use of an external energy source, such as compressed air.

An advantage that can be derived from a preferred embodiment of the present invention described below, is that the gripper head may be fitted for manual operation by providing a handle for mechanically activating the cylinderneedle mechanism. Furthermore, the gripper head can be attached to a machine which can operate the gripper head mechanically or by means of compressed air. A further advantage described below, is that the axial translation of the cylinders and needles of the gripper head can be accurately and reproducibly adjusted.

DETAILED DESCRIPTION OF THE PRESENTLY PREFERRED EMBODIMENTS

Figure 1:
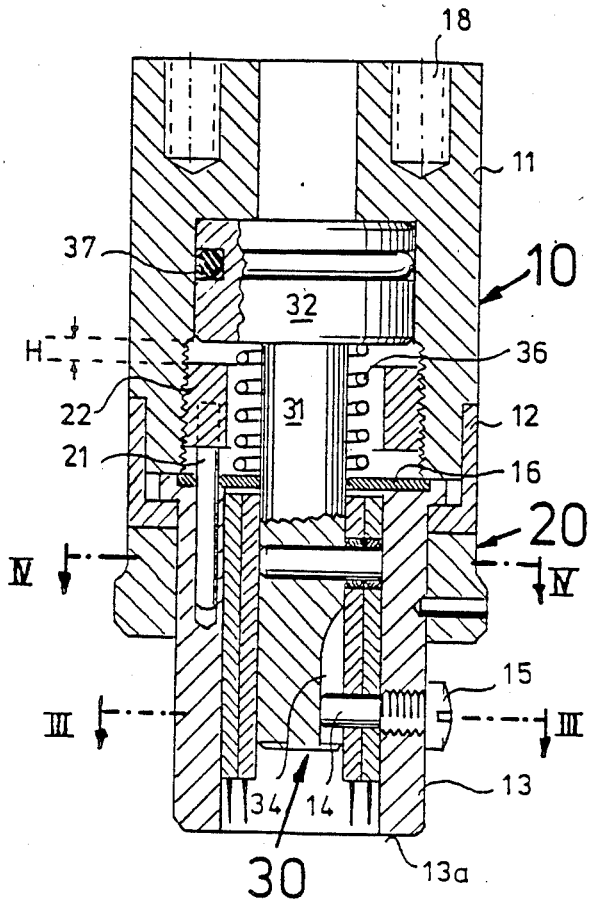
FIG. 1 is a longitudinal cross-section of a presently preferred embodiment of this invention.

Turning now to the drawings, FIG. 1 is a longitudinal cross-sectional representation of a gripper head of a presently preferred embodiment. The main components of the gripper head are: a casing 10 with adjusting ring 20, a central presser bolt 30 with concentric hollow cylinders 41, 42 concentrically mounted within the casing 10 and concentrically mounted about the presser bolt 30.

The casing 10 comprises an upper fixed component 11, on which a component 13 is rotatably supported with the aid of a flange 12. The housing component 13 can be rotated with respect to the fixed casing components 11, 12 by means of the adjusting ring 20.

During the rotation of the adjusting ring 20, an axially arranged pin 21, which is axially slidable within the casing component 13, carries along a stop ring 22. The stop ring 22 is provided with an outside threaded region. The fixed casing component 11, within which the threaded stop ring 22 rotates, is provided with an inside region of corresponding threads. The stop ring 22 serves as an axial stop for the presser bolt 30, as described below.

The presser bolt 30 has a cylindrical shaft 31 and a thickened cylindrical head 32. A pin 33 passes into the shaft 31 diametrically and projects laterally from the shaft 31.

A second pin 14 engages an axially running longitudinal groove 34 located in the lower part of the shaft 31.

The pin 14 is fastened, with the aid of a threaded component with head 15, in the casing component 13.

Figure 2:
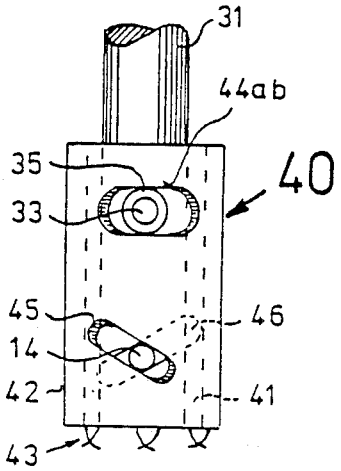
FIG. 2 is a side view of the needle-fitted, concentric cylinders includes in the embodiment of FIG. 1.
Figure 3:
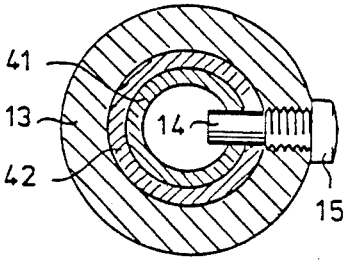
FIG. 3 is a cross-sectional representation along the line III—III in FIG. 1.
Figure 4:
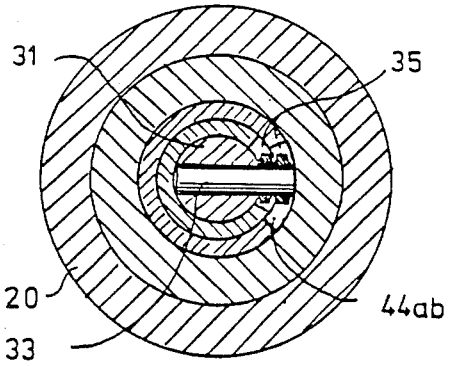
FIG. 4 is a cross-sectional representation along the line IV—IV of FIG. 1.

FIG. 2 shows the two hollow cylinders 41, 42 mounted concentrically about the shaft 31. Each cylinder 41, 42 comprises an end which faces the piece of material to be picked-up. The cylinders 41, 42 are fitted on their face ends with curved needles 43, oriented in the circumferential direction. The curved needles 43 of one cylinder 41, 42 point in one circumferential direction and the curved needles 43 of the other cylinder 41, 42 point in the opposite circumferential direction. The pin 33, located in the shaft 31 of the presser bolt 30, extends through the horizontally running slits 44*a*, 44*b* in the hollow cylinders 41, 42. The pin 33 extends to the outer circumference of the outer hollow cylinder 42. The slits 44*a*, 44*b* are sufficiently larger in width than the diameter of the pin 33 to allow small rollers 35 to be placed on the pin 33. Below the slits 44*a*, 44*b* there are arranged in each hollow cylinder 41, 42 an oblique, guide slit 45, 46. The pitch direction of one slit 45, 46 is opposite the pitch direction of the other slit 45, 46. The pin 14 extends through both slits 45, 46 at the point at which the two slits 45, 46 intersect.

When presser bolt shaft 31 moves downward, the pin 33, by means of the rollers 35 engaging the slits 44*a*, 44*b*, carries both hollow cylinders 41, 42 downwardly with the shaft 31. The shape and orientation of the slits 44*a*, 44*b* and the cooperation of the pin 33 and the rollers 35 allow both cylinders 41, 42 to rotate about the shaft 31 and the outer cylinder 42 to rotate about the inner cylinder 41.

During the downward movement of the shaft 31, the pin 14 located in the casing component 13 continues to remain in engagement with the two intersecting slits 45, 46. This engagement produces the rotation of the two cylinders 41, 42 in opposite directions.

Pin 33 remains with the presser bolt 31 and is moved up and down within the casing 10. Pin 33 ensures that the two hollow cylinders 41, 42 move up and down in synchronism with the presser bolt 30. However, because of the shape and orientation of the slits 44*a*, 44*b*, the cylinders 41, 42 are permitted to rotate about the shaft 31. The pin 14, fixedly mounted in the casing component 13, does not participate in the up and down movement of the presser bolt 30. The pin 14 operates to prevent the shaft 31 from rotating because of the engagement of the pin 14 with the axially running slit 34. Since the pin 14 also passes through the slits 45, 46 which run in a spiral direction about the cylinders 41, 42, an up or down movement of the cylinders 41, 42 produces rotation in opposite directions of the cylinders 41, 42 about the presser bolt shaft 31.

The aforementioned up and down movement of the presser bolt 30 may be brought about by acting upon the head 32 with compressed air or by mechanical action. To aid in this movement, a resetting spring 36 is located under the head 32 and abuts an angular plate 16 lying within the casing component 13. The resetting spring 36 biases the presser bolt 30 to a retracted position.

The amount of the downward movement, or stroke H, is determined by the position of a stop ring 22 in the fixed casing component 11. For proper operation of the gripper head it is important that the stroke H be accurately and sensitively adjustable. The magnitude of the stroke H determines how far the needles 43 emerge from the casing 10 and simultaneously the degree of their rotation.

A sensitive adjustment of the stroke H can be performed by means of the adjusting ring 20. The rotation of the adjusting ring 20 relative to the fixed component parts 11, 12 produces rotation of the casing component 13 and all the components fastened to it. Therefore, by means of the pin 21, rotation of the adjusting ring 20 produces rotation of the stop ring 22. The rotation of the stop ring 22, with outside threads, relative to the fixed casing component 11, with inside threads, permits a micrometer-type adjustment of the stroke H.

Figure 5:
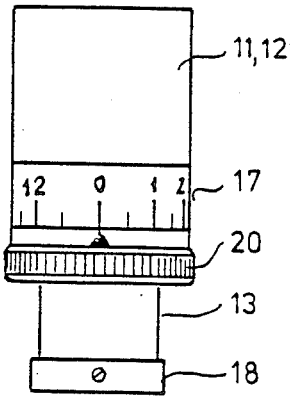
FIG. 5 is a side view of a portion of the preferred embodiment shown in FIG. 1.

A side elevation view of a portion of the gripper head is represented in FIG. 5. On the outside of the fixed casing component 11, 12 a scale 17 is mounted. An arrow located on the adjusting ring 20 indicates the position of the rotatable casing component 13 with respect to the fixed casing component 11, 12. As described above, this position determines the magnitude of the stroke H and the corresponding extension of the needles 43 from the casing component 13.

Figure 6:
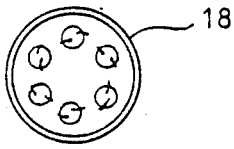
FIG. 6 is an end view of a protective cap for the needles of the preferred embodiment shown in FIG. 1.

The adjustment must be made with high precision and hairline accuracy so that the needle points 43 project from the lower edge 13*a* of the casing component 13 exactly in correspondence to the thickness and quality of the piece of material. During the pick-up operation, the lower edge 13*a* is firmly pressed onto a stack of material in order to remove from the stack the top piece of material. It has proved advantageous in this operation to use a cover cap 18 as represented in FIG. 6. The cap 18 is provided with openings through which the needle points 43 may project. The cap 18 provides a larger surface than the casing edge 13a with which to press the material and hold it flat so that the needle points 43 do not penetrate too deeply.

As noted above, the actuation of the gripper head can occur either mechanically or by means of compressed air. For operations by means of compressed air, the head 32 of the presser bolt 30 is constructed like a piston, with a sealing O-ring 37, which is movable up and down in a cylindrical bore within the casing component 11. When the gripper head is attached to a machine for moving pieces of material, the actuation of the head will preferably be carried out using compressed air.

Figure 7:
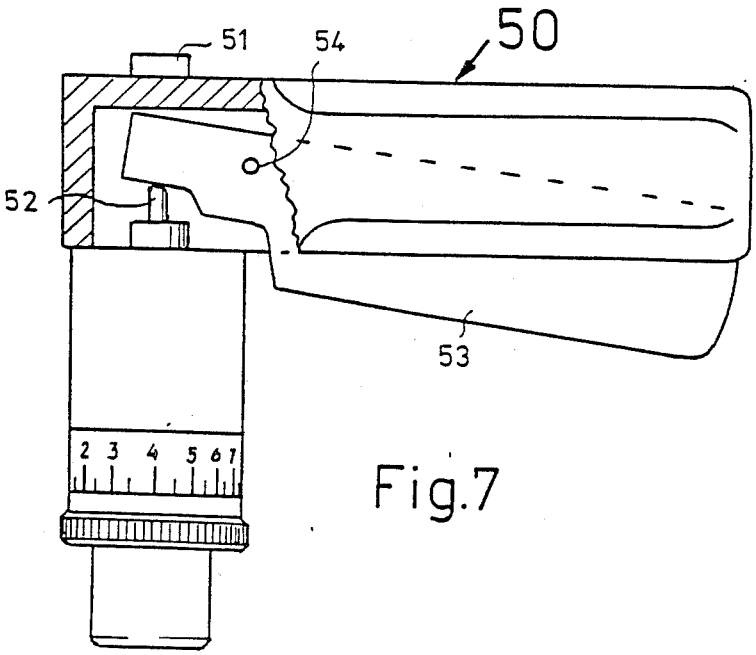
FIG. 7 is a representation of a second preferred embodiment of the present invention.

In cases where heretofore pieces of material could be taken up singly from a stack only by hand, it is now possible to operate advantageously with a hand-actuated gripper head. In FIG. 7 there is shown such a gripper head equipped with a grip 50 for manual operations.

The grip 50 is joined to the gripper head by means of screws 51 which engage the threaded bores 18 of the casing component 11, see FIG. 1. The manual operation of the presser shaft 31 occurs by means of a pin 52 guided within the casing component 11. A handle 53, which is rotatable about a bolt 44, is substantially mounted within an appropriately shaped cavity of the grip casing 50.

Of course, it should be understood that a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of this invention.

I claim:

1. In a gripper head of the type for singly picking-up the upper most lying piece of cloth material or similar stickable material from a stack of such material pieces, the gripper head comprising a casing and at least two hollow cylinders, each cylinder defining an end face which faces towards the material pieces, the cylinders mounted concentrically and rotatably, the gripper head further comprising a plurality of needles mounted on the end face of each cylinder, the improvements comprising:

means for mounting the cylinders to permit axial translation of the cylinders with respect to the casing as well as opposed rotation of the cylinders;

means for rotating the cylinders in opposed directions in response to axial translation of the cylinders with respect to the casing, said rotating means comprising a guide slit located on each cylinder, each slit defining a pitch direction, the slits arranged on the cylinders such that the pitch direction of the slit of one cylinder is opposite to the pitch direction of the slit of at least one other cylinder; and at least one return spring for biasing the cylinders in the axial direction to a rest position;

the casing, mounting means, guide slits and return spring operable under forces sufficient to overcome the bias of the return spring to rotate at least one cylinder and its associated needles in a direction opposite to the direction of rotation of at least one other cylinder and its associated needles during axial advancement of the cylinders and needles to a point whereby the needles extend beyond the edge of the casing.

2. The gripper head of claim 1 wherein the guide slits of the cylinders are arranged to produce a region of common intersection, the improvement further comprises:

a presser bolt mounted concentrically within the concentric hollow cylinders;

a first pin mounted to the presser bolt;

a groove on each cylinder through which the first pin passes, the grooves and first pin operable to substantially prevent axial movement and permit rotational movement of the cylinders with respect to the presser bolt; and a second pin fixedly mounted to the casing and engaging every one of the guide slits in the region of their common intersection.

3. The gripper head of claim 2 wherein the presser bolt comprises a head of greater diameter than the presser bolt, the improvement further comprising:

a disk located within and fixed to the casing such that the return spring lies between the presser head and the disk;

the disk, return spring and presser head operable to bias the presser bolt to the rest position.

4. The gripper head of claim 1 wherein the rotation of the cylinders and the needles occurs simultaneously with the axial advancement of the cylinders and the needles.

5. The gripper head of claim 1 wherein the casing, mounting means, guide slits and return spring are further operable under forces not sufficient to overcome the bias of the return spring to retract the cylinders and needles to the rest position whereby the needles do not substantially extend beyond the edge of the casing.

6. The gripper head of claim 5 wherein each rotatable cylinder rotates during retraction in a direction opposite to the direction it rotated during axial advancement.

7. The gripper head of claim 6 wherein the rotation of the cylinders and needles occurs simultaneously with the axial movement of the cylinders and needles.

8. In a gripper head of the type for singly picking-up the upper most lying piece of cloth material or similar stickable material from a stack of such material pieces, the gripper head comprising a casing and at least two hollow cylinders, each cylinder defining an end face which faces towards the material pieces, the cylinders mounted concentrically and rotatably, the gripper head further comprising a plurality of needles mounted on the end face of each cylinder, the improvements comprising:

means for mounting the cylinders within the casing to permit axial advancement and retraction of the cylinders with respect to the piece of material to be picked-up as well as simultaneous rotation of the cylinders;

means for rotating the cylinders simultaneously with the axial advancement and retraction of the cylinders such that at least one cylinder rotates in a direction opposite to the direction of rotation of at least one other cylinder;

means for biasing the cylinders in the axial direction to a rest position whereby the needles mounted on the ends of the cylinders do not substantially protrude from the edge of the casing;

means for adjustably limiting the axial advancement of the cylinders;

the casing, mounting means, rotating means, biasing means and limiting means cooperating under forces applied to the cylinders sufficient to overcome the biasing means to simultaneously rotate and axially advance the needles to a pre-selected position external to the casing and further cooperating upon removal of such forces to simultaneously rotate and axially retract the needles to the rest position within the casing.

9. The gripper head of claim 8 wherein each rotatable cylinder rotates during retraction in a direction opposite to the direction it rotated during axial advancement.

10. In a gripper head of the type for singly picking up the upper most lying piece of cloth material or similar stickable material from a stack of such material pieces, the gripper head comprising a casing and at least two hollow cylinders, the casing comprising a threaded inner region, each cylinder defining an end face which faces towards the material pieces, the cylinders mounted concentrically and rotatably, the gripper head further comprising a plurality of needles mounted on the end face of each cylinder, the improvements comprising:

means for mounting the cylinders to permit axial translation of the cylinders with respect to the casing as well as rotation of the cylinders;

a guide slit located on each cylinder, each slit defining a pitch direction, the slits arranged on the cylinders such that the pitch direction of the slit of one cylinder is opposed to the pitch direction of the slit of at least one other cylinder, wherein the guide slits of the cylinders are arranged to produce a region of common intersection;

a presser bolt mounted concentrically within the concentric hollow cylinders, wherein the presser bolt comprises a head of greater diameter than the presser bolt;

a first pin mounted to the presser bolt;

a groove on each cylinder through which the first pin passes, the grooves in the first pin operable to substantially prevent axial movement and permit rotational movement of the cylinders with respect to the presser bolt;

a second pin fixedly mounted to the casing and engaging every one of the guide slits in the region of their common intersection;

at least one return spring for biasing the cylinders in the axial direction to a rest position;

a disk located within and fixed to the casing such that the return spring lies between the presser head and the disk, the disk, return spring and presser head operable to bias the presser bolt to the rest position;

a stop ring comprising a threaded outer surface located in the threaded inner region of the casing; and a setting ring connected to the stop ring and extending exterior to the casing, the setting ring operable to adjust the position of the stop ring with respect to the presser head, the stop ring cooperating with the presser head to limit the axial movement of the presser head and thereby to limit the axial and rotational movement of the needles;

the casing, mounting means, guide slits and return spring operable under forces sufficient to overcome the bias of the return spring to rotate at least one cylinder and its associated needles in a direction opposite to the direction of rotation of at least one other cylinder and its associated needles to a point such that the needles extend beyond the edge of the casing.

11. The gripper head of claim 10 wherein the casing comprises an upper casing portion and a lower casing portion, and wherein the improvement further comprises:

a third pin associated with the stop ring and guided by the lower casing portion such that movement of the setting ring produces rotational axial movement of the stop ring within the upper casing portion.

12. The gripper head of claim 11 wherein the improvement further comprises:

a grip connected to the casing, the grip housing a lever mechanism; and a fourth pin associated with the presser head such that the lever mechanism is operable to produce axial movement of the presser head and axial and opposed rotational movement of the needles.

13. In a gripper head of the type for singly picking-up the upper most lying piece of cloth material or similar stickable material from a stack of such material pieces, the gripper head comprising a casing and at least two hollow cylinders, each cylinder defining an end face which faces towards the material pieces, the cylinders mounted concentrically and rotatably, the gripper head further comprising a plurality of needles mounted on the end face of each cylinder, the improvements comprising:

means for mounting the cylinders to permit axial translation of the cylinders with respect to the casing as well as rotation of the cylinders;

a guide slit located on each cylinder, each slit defining a pitch direction, the slits arranged on the cylinders such that the pitch direction of the slit of one cylinder is opposed to the pitch direction of the slit of at least one other cylinder, wherein the guide slits of the cylinders are arranged to produce a region of common intersection;

a presser bolt mounted concentrically within the concentric hollow cylinders, wherein the presser bolt comprises a head of greater diameter than the presser bolt;

a first pin mounted to the presser bolt;

a groove on each cylinder through which the first pin passes, the grooves and first pin operable to substantially prevent axial movement and permit rotational movement of the cylinders with respect to the presser bolt;

a second pin fixably mounted to the casing and engaging every one of the guide slits in the region of their common intersection;

at least one return spring for biasing the cylinders in the axial direction to a rest position;

a disk located within and fixed to the casing such that the return spring lies between the presser head and the disk, the disk, return spring and presser head operable to bias the presser bolt to the rest position;

a cylindrical bore located in the casing and operative to guide the presser head and the associated presser bolt; and a sealing ring located about the presser head and between the presser head and the cylinder bore, the cylindrical bore, presser head and sealing ring operable to produce axial movement of the presser head within the cylindrical bore by means of a compressed fluid such as air or liquid;

the casing, mounting means, guide slits and return spring operable under forces sufficient to overcome the bias of the return spring to rotate at least one cylinder and its associated needles in a direction opposite to the direction of rotation of at least one other cylinder and its associated needles during axial advancement of the cylinders and needles to a point such that the needles extend beyond the edge of the casing.

* * * * *